US006368781B1

(12) United States Patent
Ferguson et al.

(10) Patent No.: US 6,368,781 B1
(45) Date of Patent: Apr. 9, 2002

(54) HEAT SENSITIVITY IMPROVEMENT WITH COMBINATIONS OF GOLD SENSITIZATION AND SPECTRAL SENSITIZING DYE AND FILTER DEVICE

(75) Inventors: Pamela M. Ferguson, Farmington; Roger Lok, Rochester; Alton L. Chitty, Rochester; Norman R. Oneal, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/420,726

(22) Filed: Oct. 20, 1999

(51) Int. Cl.[7] ..... G03C 1/14; G03C 1/09; G03C 1/83

(52) U.S. Cl. ..... 430/584; 430/510; 430/511; 430/512; 430/605

(58) Field of Search ..... 430/584, 605, 430/510, 511, 512

(56) References Cited

U.S. PATENT DOCUMENTS

| | | | | |
|---|---|---|---|---|
| 3,266,897 A | | 8/1966 | Kennard et al. | |
| 4,192,026 A | | 3/1980 | Williams | |
| 4,607,004 A | | 8/1986 | Ikenoue et al. | |
| 4,920,043 A | | 4/1990 | Ohashi et al. | |
| 5,011,768 A | | 4/1991 | Ogawa | |
| 5,451,494 A | * | 9/1995 | Diehl et al. | 430/522 |
| 5,945,270 A | * | 8/1999 | Lok et al. | 430/605 |
| 5,962,211 A | | 10/1999 | Maronian et al. | |
| 5,994,050 A | * | 11/1999 | Maronian et al. | 430/584 |

FOREIGN PATENT DOCUMENTS

| | | |
|---|---|---|
| EP | 915 371 | 5/1999 |
| EP | 0 766 132 | 12/1999 |
| GB | 1275701 | 5/1972 |

* cited by examiner

*Primary Examiner*—Thorl Chea
(74) *Attorney, Agent, or Firm*—Edith A. Rice

(57) ABSTRACT

The invention relates to a photographic element comprising a support and a silve halide emulsion layer wherein the silver halide emulsion contains at least one absorber dye and at least one sensitizing dye. The wavelength of maximum absorbance of said absorber dye and the wavelength of maximum sensitivity of the emulsion provided by the spectral sensitizing dye are substantially the same. The emulsion is chemically sensitized with a stable and water soluble AuI) complex. This provides manufacturing improvements, improved detail and sharpness, improved dodging and burning and lower cost without an unwanted increase in heat sensitivity.

24 Claims, 2 Drawing Sheets

HEAT SENSITIVITY IMPROVEMENT WITH COMBINATIONS OF GOLD SENSITIZATION AND SPECTRAL SENSITIZING DYE AND FILTER DEVICE

FIELD OF INVENTION

The invention relates to an element for forming photographic images. It particularly relates to the combination of emulsion sensitization and absorbing dyes for color paper.

BACKGROUND OF THE INVENTION

Color photographic paper is used in a wide variety of photoprocessing machines, which include large-scale processors capable of providing large volumes of photographic prints under conditions of continuous operation, and small-scale processors that are used to produce smaller volumes of photographic prints under conditions of discontinuous operation. These machines are known to differ widely in mechanical design, and the operating conditions for these processors vary widely in ambient temperature and humidity due to the wide variety of environments for use.

To provide a color photographic paper that serves all the different machines and conditions and is tolerant of the wide fluctuations in environment, one must address the variation of color paper performance to changes in heat and humidity at the site of operation. One aspect of these variations relates to the sensitivity of the photographic paper to changes in temperature. It is desirable to make photographic materials that are invariant to any changes in environmental temperature, such that the photographic response does not change when the ambient temperature fluctuates during the course of processor operations. Alternatively, satisfactory results can be achieved when the photographic response is neutral with respect to changes in environmental temperature, that is, although the photographic material may have a different response as the temperature changes, the changes are not noticeable to the operator as the effects of temperature in each of the constituent layers are synchronized to annul the effect of the temperature changes.

In the manufacture of color photographic paper it is critical to maintain the activity of the photographic components such that the photographic response does not change during the course of manufacturing. To ensure a consistent outcome is obtained, it is necessary to monitor photographic activity in the process of manufacturing. During the course of manufacturing, many incidental changes can occur and impact photographic response characteristics such as photographic speed. These speed changes can be measured during the manufacturing process, and adjustments can be made to maintain a consistent response. It is of enormous benefit to the process of manufacturing photographic materials if adjustments to the levels of the components bear a linear response to the speed value. Additionally, it is obvious that if less material is utilized in obtaining the desired photographic effect, cost advantages can be accrued.

Advantages gained in the manufacture of color paper cannot be realized if photographic performance is jeopardized. Therefore, it is desired that manufacturing gains be made concomitantly with gains in photographic performance. It is known that heat sensitivity of the photographic material is critical to its acceptability for use, and that changes in heat sensitivity can occur when changes are made in the process of manufacturing; thus, it is highly desirable that manufacturing changes do not degrade heat sensitivity.

It is intended that color photographic paper satisfy the desires of photographers in the practice of their art. In the hands of the photographer, it is common practice to regulate the exposure of photographic material under conditions where some areas of the print may receive greater light exposure than a normal exposure to "burn in" the desired image to a greater degree. Alternatively, it is also the practice to shield some areas of the print from normal exposure to light, and by "dodging" the light in this way create the desired image. Color papers also vary in their undeveloped color from batch to batch, as different absorber dyes are added to adjust their properties. In practicing the techniques of dodging and burning, the photographer or enlarger operator is hindered by a color photographic material that has a dark color content prior to exposure. This makes the dodging and burning more difficult, as the paper looks different during exposure as the undeveloped paper color is different.

PROBLEM TO BE SOLVED BY THE INVENTION

There is a need for photographic paper that is more easily adjusted to control speed and sensitivity during manufacturing without demonstrating increased heat sensitivity.

SUMMARY OF THE INVENTION

It is an object of the invention to overcome disadvantages of prior photographic elements.

It is a further object of the invention to provide a color paper that is easier for the printer operator to accurately dodge and burn during printing.

A further object of the invention is to provide a color paper that has the sensitometric and speed properties adjusted during manufacturing without significantly changing the color of the undeveloped paper.

A further object of the invention is to provide a color paper that has the ease of dodging and burning,the sensitometric and speed adjustment capability during manufacture and does not have an increase in heat sensitivity.

An additional object of the invention is to provide lower manufacturing cost for color papers.

These and other objects generally are accomplished by providing a photographic element comprising at least one absorber dye and at least one sensitizing dye wherein the wavelength of maximum sensitivity of said absorber dye and the wavelength of maximum sensitivity of the emulsion provided by the spectral sensitizing dye are substantially the same and where the emulsion is chemically sensitized with an organomercapto Au(I) complex having the formula $$[L—Au—L]M$$

wherein the complex is symmetrical; L is an organomercapto ligand which is an antifogging, stabilizing or sensitizing compound, and M is a cationic counter ion. In a preferred embodiment of the invention the the silver halide grains of the emulsion contain one or more dopants as described in copending application Ser. No. 09/420,746, filed concurrently herewith, the entire disclosures of which are incorporated herein by reference. The wavelength of maximum absorbance of the absorer dye and the wavelength of maximum sensitivity f the sensitized emulsion are substantially the same. The term "substantially the same" means that the wavelength of maximum absorbance of the absorber dye is within about 15 nm, preferably within about 10 nm and most preferably within about 5 nm of the wavelength of maximum sensitivity of the sensitized emulsionl

ADVANTAGEOUS EFFECT OF THE INVENTION

An advantage of the invention is that color papers are produced that are easier to control as to sensitivity and speed during manufacturing.

DETAILED DESCRIPTION OF THE INVENTION

Figure 1:
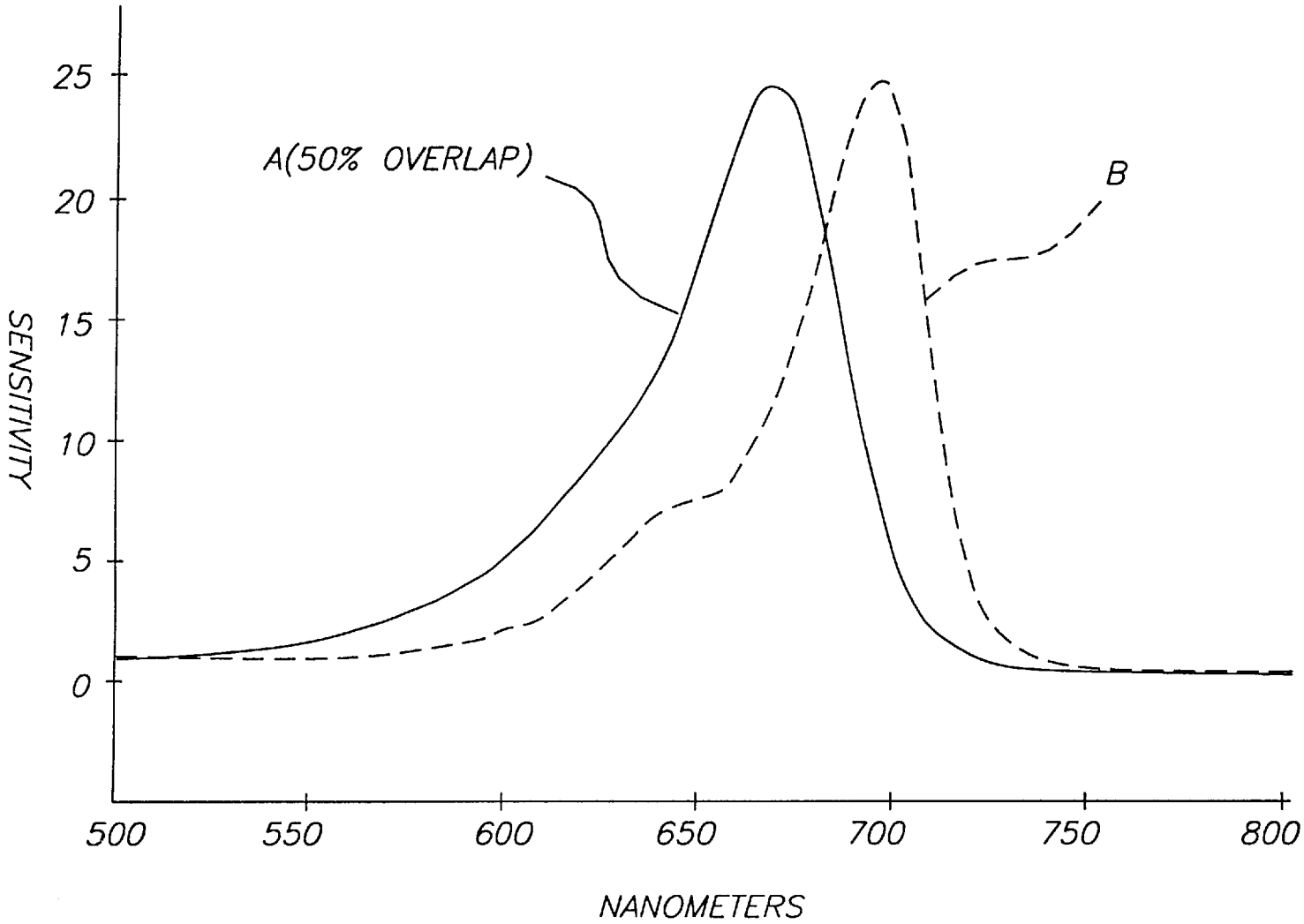
FIG. 1 is the dye sensitivity comparison of the spectral dye and absorber dyes such as in the prior art.

The invention has numerous advantages over prior photographic elements. The photographic elements of the invention are low cost manufacture, as absorber dye and sensitizing dye have the same peak response, less chemicals are needed to adjust the overall sensitivity of the photographic element. Further, the adjustment is more accurate. Since less absorbing dye is needed to make adjustments, the paper is lighter in color, as well as varying less in color between batches as different adjustments are made. There is a cost savings as less chemicals are utilized for adjusting the paper properties during manufacturing. Further, there is greater customer satisfaction as the paper always looks the same. Customers previously were uneasy in that the color of unexposed paper would vary even though the pictures developed from the paper were very uniform. invention, the printer operator can more easily dodge and burn as the paper is light colored, and this light color does not vary significantly from batch to batch. These and other advantages of the invention will be apparent from the detailed description below.

In the manufacture of color paper and other photographic products such as color negative film, it is known to adjust the speed of the paper by the use of absorber dyes. These absorber dyes allow the photographic elements to be sold with a fixed speed over a period of time even though the speed of the photographic emulsions may vary somewhat in manufacture over time. By the use of the dyes, the speed is adjusted to a constant over time.

In the invention the absorber dye is selected to have similar response to light as the spectral sensitizing dyes for the emulsions and the emulsion is chemically sensitized with an organomercapto Au(I) complex. While absorber dyes have been used in the art, there is recognition of the benefits of adjusting the band absorption of the absorber dyes to be generally the same as those of the spectral sensitizing dyes. It has been found that to obtain the benefits of the invention that the peak responses of the spectral sensitizing dye and the absorber dye should overlap for at least 75% of the spectral envelope of the spectral sensitizing dye. It is suitable that the dyes have a spectral envelope overlap of 75% or greater. Spectral envelope is the area underneath the spectral sensitization curve of the particular spectral sensitizing dye. The spectral sensitization curve is determined by the sensitivity of the silver halide to different wavelengths of light for a particular sensitizing dye. This is done by using a standard wedge spectrophotometer. It is preferred that the absorber dye overlap at least 90% or greater than 90% of the spectral envelope of the spectral sensitizing dye for the easiest adjustment of speed with the use of the least absorbing dye and best maintaining of the sharpness of the photographic element.

The invention may be utilized to match spectral sensitization and absorber dye in any color photographic product. The dye adjustment of peak sensitivity may be used in the red, blue, or green sensitive layer. A preferred use has been found to be in the red sensitive layer, as addition of the absorbing dyes in this layer results in a darker photographic element that makes printing more difficult, as dodging and burning is more difficult to carry out on the dark color, color paper, and presently used dyes are wide apart in peak sensitivity. Linear adjustment of speed values during manufacturing is possible when the absorber and spectral dyes have the same peak as in the invention.

Any red spectral sensitizing dye may be utilized in the red light sensitive layer of a photographic element. Suitable for use in color paper are the red sensitizer dyes symmetrical or unsymmetrical benzothiazoledicarbocyanines, benzoxazole dicarbo-cyanines, benzothiazole-benzoxazole dicarbocyanines, for example, those sensitizing dyes described in *Research Disclosure*#38957, September 1996. Preferred for use in color paper are sensitizer dyes symmetrical or unsymmetrical benzothiazoledicarbocyanines.

In accordance with a preferred embodiment of the invention, the red sensitizing dye is selected from Dye A, Dye B and mixtures thereof, wherein Dye A is of formula I or II:

I

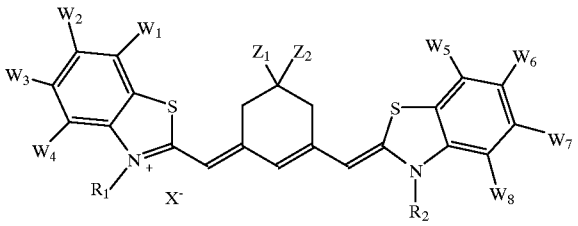

II

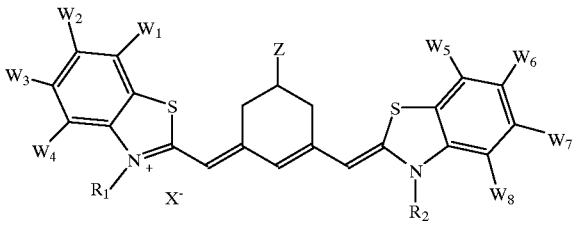

wherein:

in formula I, the substituents $W_1$–$W_8$ are chosen such that J is greater than or equal to 0.0, where J is defined a s the sum of he Hammet $\sigma_p$ values of $W_1$–$W_8$, or in formula II, the substituents $W_1$–$W_8$ are chosen such that J is greater than or equal to 0.24;

$R_1$ and $R_2$ each independently represents an alkyl group or a substituted alkyl group;

$Z_1$ and $Z_2$ each independently represents a 1–8 carbon alkyl group.

X is a counterion, if needed, to balance the charge of the dye; and Dye B is of formula I or II wherein: in formula I, the substituents $W_1$–$W_8$ are chosen such that J is less that 0.10, or in formula II, the substituents $W_1$–$W_8$ are chosen such that J is less that −0.14; and $R_1$ and $R_2$ each independently represents an alkyl group or a substituted alkyl group;

X is a counterion, if needed, to balance the charge of the dye;

Z is a hydrogen or halogen atom or an alkyl group or a substituted alkyl group.

In the above formulae (I) and (II), $W_1$–$W_8$ each independently represent an alky, acyl, acyloxy, alkoxycarbonyl, carbonyl, carbamoyl, sulfamoyl, carboxyl, cyano, hydroxy, amino, acylamino, alkoxy, alkylthio, alkylsulfonyl, sulfonic acid, aryl, or aryloxy group, any of which may be substituted or unsubstituted, or a hydrogen or halogen atom, and provided further that adjacent ones of $W_1$–$W_8$ can bonded to each other via their carbon atoms to form a condensed ring. Dye A has structure I and substituents $W_1$ –$W_8$ are chosen such that J is ≧0.0, or, alternatively, Dye A can also have the structure II provided substituents $W_1$–$W_8$ are chosen such that J is ≧0.24 and Dye B has structure II and substituents $W_1$–$W_8$ are chosen such that J is ≦0.10, or, alternatively, Dye B can also have structure I provided substituents $W_1$–W8 are chosen such that J is ≦−0.14. Hammett $\sigma_p$ values are discussed in *Advanced Organic Chemistry* 3rd Ed., J. March, (John Wiley Sons, NY; 1985). Note that the "p" subscript refers to the fact that the σ values are measured with the substituents in the para position.

Z is a hydrogen or halogen atom or an alkyl group or substituted alkyl group, for example a 1 to 8 carbon atom alkyl group or substituted alkyl group. Preferably Z is a relatively "flat" substituent, such as a hydrogen, halogen or a methyl (substituted or unsubstituted). More particularly Z may be a substituted or unsubstituted methyl or a hydrogen.

$Z_1$ and $Z_2$ are independently be a 1 to 8 carbon alkyl group (for example, methyl, ethyl, propyl, butyl or the like).

Preferably at least one of $R_1$ or $R_2$, or both, are alkyl of 1–8 carbon atoms, either of which alkyl may be substituted or unsubstituted. Examples of preferred substituents include acid or acid salt groups (for example, sulfo or carboxy groups). Thus, either or both $R_1$ or $R_2$ could be, for example, 2-sulfobutyl, 3-sulfopropyl and the like, or sulfoethyl.

Examples of Dye A and Dye B used in materials of the present invention are listed below in Table A, but the present invention is not limited to the use of these dyes.

TABLE A

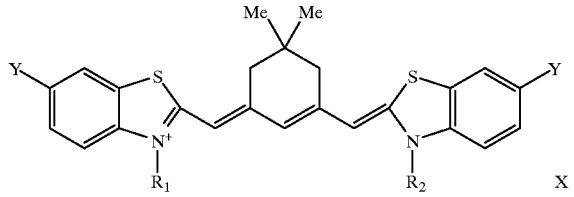

| Dye | Dye Type | Y | R1 | R2 | X |
|---|---|---|---|---|---|
| RSD-1 | A | H | 3Sp | Et | — |
| RSD-2 | A | H | Et | Et | $pts^-$ |
| RSD-3 | B | Me | Et | Et | $pts^-$ |

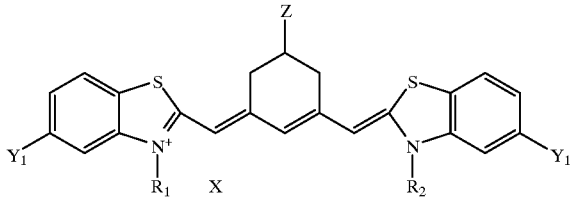

| Dye | Dye Type | Z | Y1 | R1 | R2 | X |
|---|---|---|---|---|---|---|
| RSD-4 | A | H | Cl | Et | Et | $pts^-$ |
| RSD-5 | B | H | H | Et | Et | $pts^-$ |
| RSD-6 | B | H | Ph | Et | Et | $pts^-$ |
| RSD-7 | B | Me | H | Et | Et | $BF_4^-$ |

3Sp is 3-sulfopropyl, $pts^-$ is p-toluenesulfonate

In a preferred embodiment of the invention a silver halide photographic material comprises a red sensitive silver halide emulsion layer which has a dye of formula (Ia) used in combinations with a dye for formula (IIa):

(Ia)

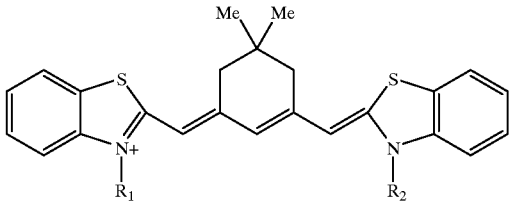

A (IIa)

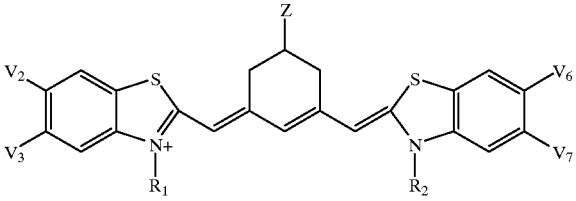

A where:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

Sensitizing dyes which are particularly valuable in red spectrally sensitized emulsions are shown below:

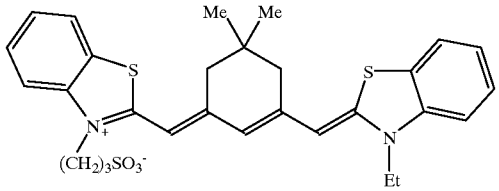

RSD-1

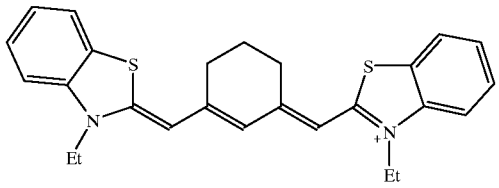

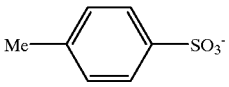

RSD-5

When reference in this application is made to a substituent "group", this means that the substituent may itself be substituted or unsubstituted (for example "alkyl group" refers to a substituted or unsubstituted alkyl). Generally, unless otherwise specifically stated, substituents on any "groups" referenced herein or where something is stated to be possibly substituted, include the possibility of any groups, whether substituted or unsubstituted, which do not destroy properties necessary for the photographic utility. It will also be understood throughout this application that reference to a compound of a particular general formula includes those compounds of other more specific formula which specific formula falls within the general formula definition. Examples of substituents on any of the mentioned groups can include known substituents, such as: halogen, for example, chloro, fluoro, bromo, iodo; alkoxy, particularly those with 1 to 6 carbon atoms (for example, methoxy, ethoxy); substituted or unsubstituted alkyl, particularly lower alkyl (for example, methyl, trifluoromethyl); alkenyl or thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); and others known in the art. Alkyl substituents may specifically include "lower alkyl", that is having from 1 to 6 carbon atoms, for example, methyl, ethyl, and the like. Further, with regard to any alkyl group, alkylene group or alkenyl group, it will be understood that these can be branched or unbranched and include ring structures.

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, the combination of similarly spectrally sensitized emulsions can be in one or more layers.

As mentioned above, the filter dye preferably is of the formula:

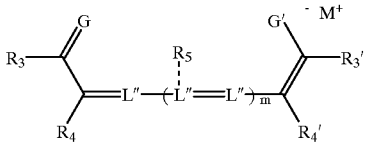

wherein:

G and G' independently represent oxygen, substituted nitrogen, or $C(CN)_2$;

$R_3$, $R_3'$, $R_4$, $R_4'$ independently represent H or a substituent, or $R_3$ and $R_4$, $R_3'$ and $R_4'$ may form a ring;

$R_5$ is an acyl alkyl, aryl, alkyloxy, aryloxy, amino, or heterocyclic, any of which may be substituted or unsubstituted;

m is 0, 1, 2, or 3;

all of the L" together define a methine chain each L" representing a methine any of which may be substituted or unsubstituted; and $M^+$ is a cation.

Filter dyes of the above formula are described in more detail in U.S. Pat. No. 5,451,494, the entire disclosures of which are incorporated herein by reference.

Particularly preferred filter dyes are of the formula:

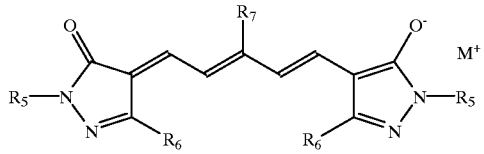

wherein $R_5$ and $R_6$ each independently represent H or a substituent, or $R_5$ and $R_6$ may form a ring;

$R_7$ is an acyl, alkoxycarbonyl, amido, carbamoyl, alkyl, aryl, alkoxy, aryloxy, amino, or heterocyclic, any of which may be substituted or unsubstituted; and $M^+$ is a cation or proton.

Hereunder, the typical examples of the photographic filter dyes relating to the present invention are given in Table 1. However, the present invention shall not be limited to use thereto.

TABLE 1

Filter Dyes Useful in the Invention

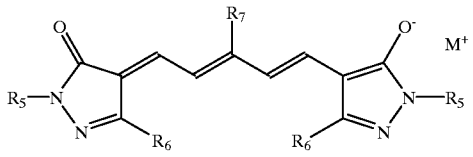

| Invention Filter Dye | $R_5$ | $R_6$ | $R_7$ | M+ |
|---|---|---|---|---|
| FD1 | 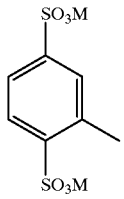 | 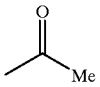 | Me | Na |

TABLE 1-continued
Filter Dyes Useful in the Invention
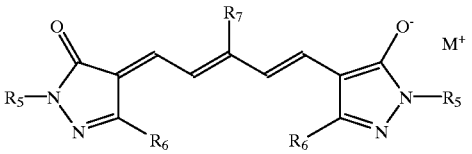
| Invention Filter Dye | $R_5$ | $R_6$ | $R_7$ | M+ |
|---|---|---|---|---|
| FD2 | 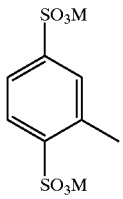 | 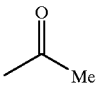 | 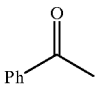 | Na |
| FD3 | 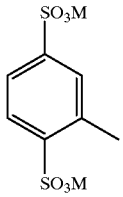 | 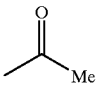 | 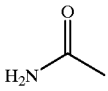 | Na |
| FD4 | 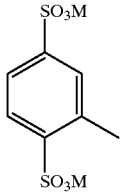 | 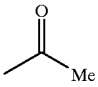 | 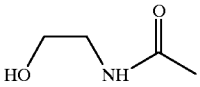 | Na |
| FD5 | 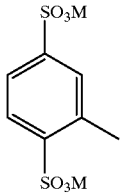 | 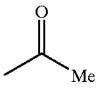 | 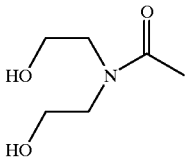 | Na |
| FD6 | 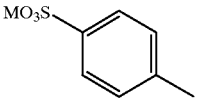 | $—CONH_2$ | 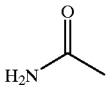 | Na |
| FD7 | 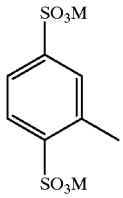 | 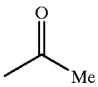 | 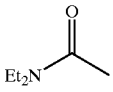 | Na |

TABLE 1-continued

Filter Dyes Useful in the Invention

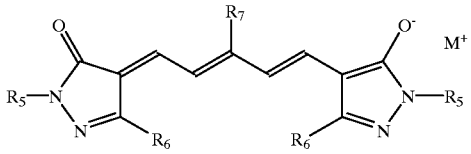

| Invention Filter Dye | $R_5$ | $R_6$ | $R_7$ | M+ |
|---|---|---|---|---|
| FD8 | 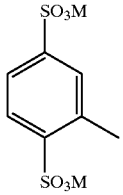 | 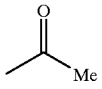 | 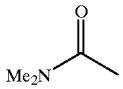 | Na |
| FD9 | 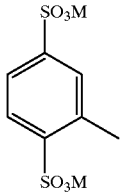 | 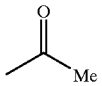 | 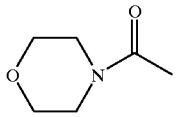 | Na |
| FD10 | 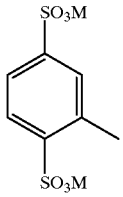 | 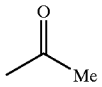 | 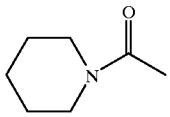 | Na |
| FD11 | 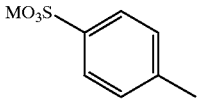 | $—CO_2M$ | 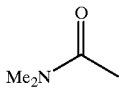 | Na |
| FD12 | 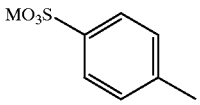 | $—CO_2M$ | 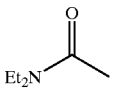 | Na |
| FD13 | 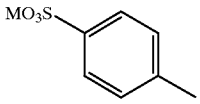 | $—CO_2M$ | 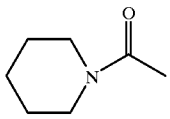 | K |

Preferred red absorber dyes have a peak sensitivity the same as the peak sensitivity of the preferred sensitizing dyes. Preferred absorber dye is FD13.

The selection of pairs of absorber and sensitizing dyes having the same peak sensitivites for the green sensitive and blue sensitive layers also may be carried out.

The spectral envelope of a dye may be determined by several techniques. A suitable technique is absorbance spectrophotometry.

Illustrated in FIG. 1 attached are figures illustrating the overlapping of the spectral sensitivity of the red sensitizing dye and red absorbing dye of a representative prior art paper. As can be seen, the spectral red absorber dye curve A does not closely match the spectral sensitizing dye curve B of the absorbing dye. The area underneath the curves above the horizontal axis is referred to as the spectral envelope with a dye. As can be seen in the drawing of FIG. 1, the overlap is at about 50%. The failure of the dye to have the same peak sensitivity means that more of the absorbing dye needs to be added to control the response of the sensitizing dye than if the peaks were the same. This leads to the following disadvantages. The color paper is darker and, therefore, more difficult for a printer operator to burn and dodge. Also, sharpness can only be obtained at high and expensive amounts of absorber dyes. Also, detail is less because less cyan dye is formed in the paper due to green exposure from the higher red density regions of the negative image.

Figure 2:
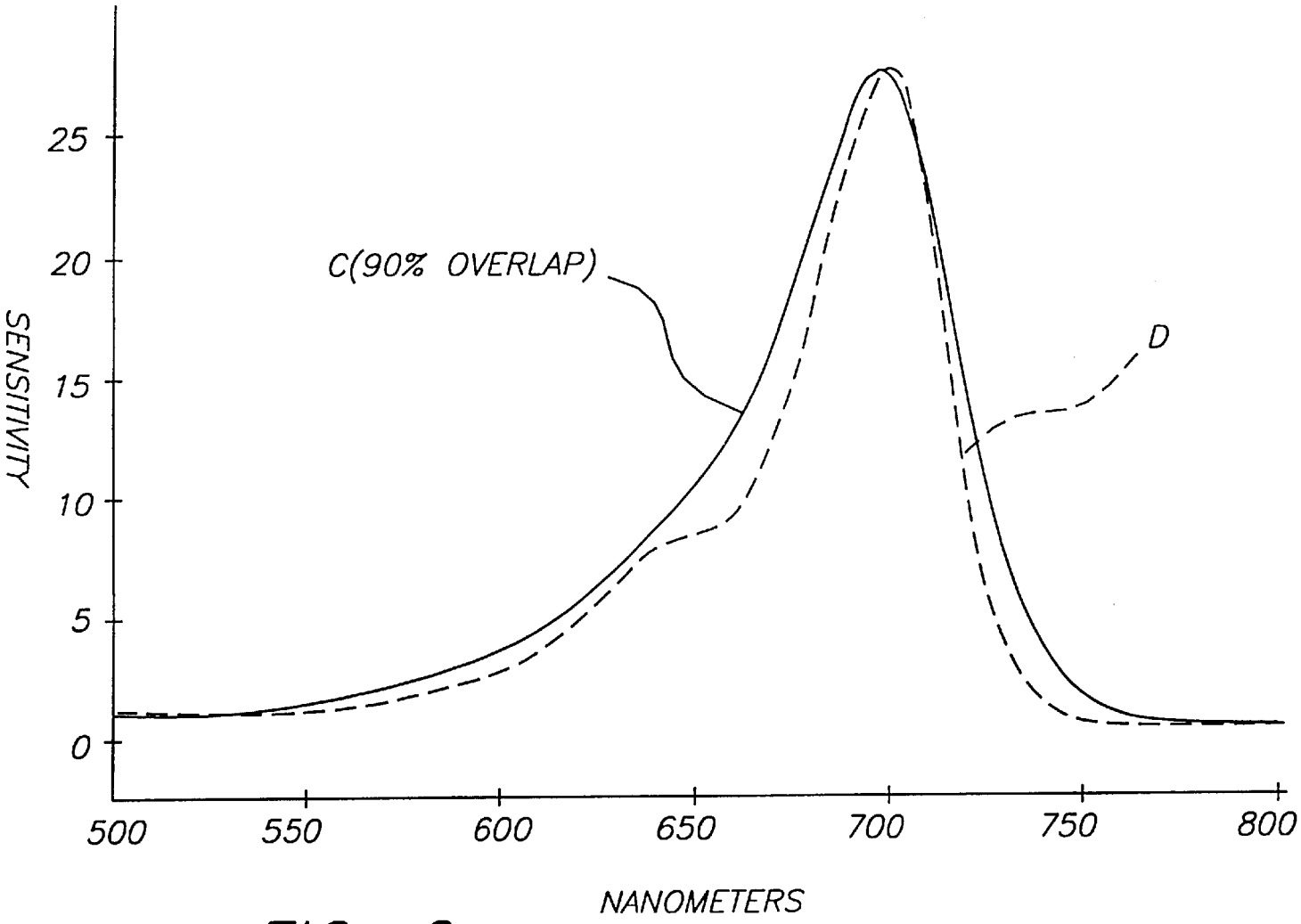
FIG. 2 is the dye sensitivity comparison of a spectral dye and absorber dyes in accordance with the invention.

In FIG. 2, there is shown a pair of red sensitizing dye 8 (curve D) and red absorbing dye 7 (curve C) curves of dyes of the invention. As shown in FIG. 2, these dyes have a peak sensitivity that overlaps at about 90% of their spectral envelope. This leads to the advantage that less dye is needed to change the sensitivity to the same degree, and further red detail is enhanced because additional cyan dye is formed as a result of increased paper red sensitivity (in the 625–700 nm spectral region) in the red regions of the image. The resulting invention's overall red sensitivity is increased, compared to the current papers, in the above-specified spectral region. This increased red spectral sensitivity region (in the photographic paper) forms proportionately more cyan image dye yielding improved perceptual red detail. Further, sharpness is not deteriorated because control is now linear and further sharpness can be achieved with less absorber dye than in FIG. 1.

The organomercapto Au(I) complexes contained in the photographic elements of this invention have numerous advantages. They are highly effective sensitizers for silver halide emulsions. They are also highly water soluble. Because of the water solubility of these complexes, the use of costly and time consuming preparation of gel dispersions is unnecessary. Further, there is no need to use large volumes of water for dissolving the complexes.

Unlike prior mixed-ligand gold compounds, the two Au ligands in the complexes of this invention are identical, thus reducing the complexity of preparation. Further, the complexes utilize inexpensive and commercially available starting materials. Another advantage is that the preparation of the gold complexes of the present invention does not utilize dangerous explosive gold fulminates or large quantities of organic solvents.

Additionally, because of the stability of the covalent gold and sulfur bonds, the complexes of the present invention are more stable than those having mesoionic ligands. Indeed, there is evidence that even in acidic solutions, the complexes of the present invention are more stable than those of the mesoionic sensitizers.

The organomercaptides used in the preparation of the Au(I) complexes may include the numerous thiolic antifoggants/stabilizers. Because of the sensitizing, antifogging, and stabilizing properties of these thiolic ligands, the Au(I) sensitizers derived from these ligands may also show speed enhancing and antifogging/stabilizing effects in addition to their sensitizing properties The water soluble organomercapto Au(I) complexes of this invention may be represented by the formula $$[L—Au—L]M$$

wherein the complex is symmetrical. L is an organomercapto ligand which has antifogging, stabilizing or sensitizing properties and which is suitable for use in a silver halide photographic element. Many such ligands are known in the art and are either commercially available or may be prepared as described in *Research Disclosure* 274 (1984). Some suitable ligands include thiolic ligands having hydrophilic substituents such as mercaptoazoles, examples of which are contained in U.S. Pat. Nos. 3,266,897; 4,607,004; 3,266,897; 4,920,043; 4,912,026; 5,011,768 and U.K. Patent 1,275,701. M is a cationic counter ion.

Particularly preferred are organomercapto Au(I) complexes of the formula:

$$[(M—SOL)_n—A—S—Au—S—A—(SOL—M)_n]M$$

with the complex being symmetrical. M is a cationic counterion. Preferably M is an alkali metal, for example potassium, sodium or cesium, or an ammonium cation, for example, a tetrabutyl or tetraethyl ammonium group. SOL is a water solubilizing group, suitable examples of which are sulfato, sulfonato, sulfinato, phosphato, and carboxy groups. n is an integer from 1 to 4, and more preferably n is 1 or 2.

A is a substituted or unsubstituted divalent organic radical. Preferably A is an aliphatic, (cyclic or acyclic), aromatic or heterocyclic divalent group. When A is an aliphatic group, preferably it is a substituted or unsubstituted aliphatic group having 1 to 20 carbon atoms, and more preferably having 1 to 8 carbon atoms. Examples of appropriate groups include alkylene groups such as ethylene, methylene, propylene, butylene, pentylene, hexylene, octylene, 2-ethylhexylene, decylene, dodecylene, hexadecylene, octadecylene, cyclohexylene, isopropylene and t-butylene groups.

The preferred aromatic groups have from 6 to 20 carbon atoms.

More preferably, the aromatic groups have 6 to 10 carbon atoms and include, among others, phenylene and naphthylene groups. These groups may have substituent groups. The heterocyclic groups are preferably substituted or unsubstituted divalent 3 to 15-membered rings with at least one atom selected from nitrogen, oxygen, sulfur, selenium and tellurium in the ring nucleus. More preferably, the heterocyclic groups are 5 to 6-membered rings with at least one atom, and preferably more than one atom, selected from nitrogen. Examples of heterocyclic groups include the divalent radicals of pyrrolidine, piperidine, pyridine, tetrahydrofuran, thiophene, oxazole, thiazole, imidazole, benzothiazole, benzoxazole, benzimidazole, selenazole, benzoselenazole, tellurazole, triazole, benzotriazole, tetrazole, oxadiazole, or thiadiazole rings. The preferred heterocyclic group is tetrazole.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be bonded to the remainder of the molecule by an atom of carbon, silicon, oxygen, nitrogen, phosphorous, or sulfur. Suitable substituents for A include, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as tiethylammonium, and silyloxy, such as trimethylsilyloxy. One particularly suitable substituent for A is a benzamido group.

Generally, the above groups and substituents thereof may include those having up to 48 carbon atoms, typically 1 to 36 carbon atoms and usually less than 24 carbon atoms, but greater numbers are possible depending on the particular substituents selected.

When A is substituted, $(SOL—M)_n$ may be attached to the substituent. In one suitable embodiment $A—(SOL—M)_n$ (wherein n is 1) is

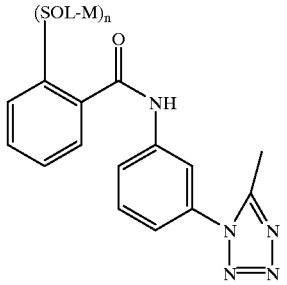

Specific examples of the Au(I) complexes include, but are not limited to (A)

$NaAu—(SCH_2CO_2Na)_2$ (B)

$NaAu—(SCH_2CH_2CHOMeCH_2OPO_3Na)_2$ (C)

$NaAu—(SCH_2CHOHCH_2SO_3Na)_2$ (D)

$NaAu—(SCH_2CH_2SO_2Na)_2$ (E)

$KAu—(SCHMeCHClCH_2CH_2SO_3K)_2$ (F)

$CsAu—(SCH_2CHCNCH_2CH_2PO_3Cs)_2$ (G)

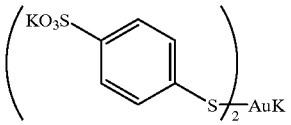

(H)

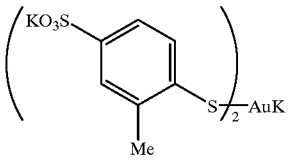

(I)

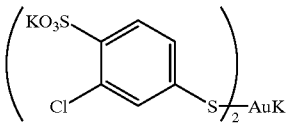

(J)

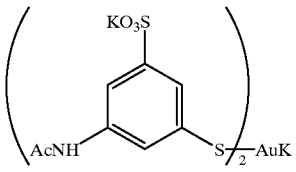

-continued (K)

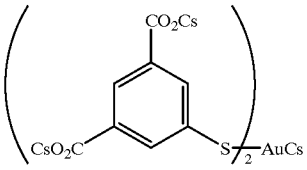

(L)

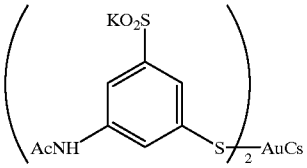

(M)

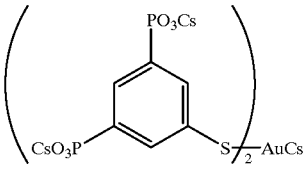

(N)

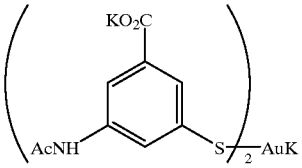

(O)

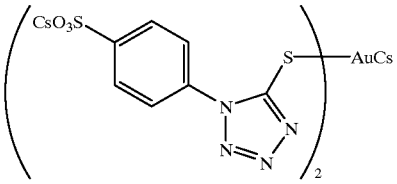

(P)

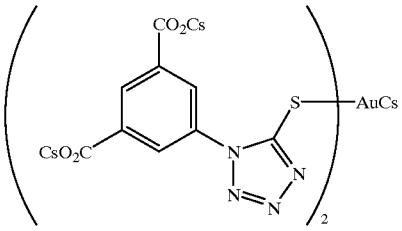

(Q)

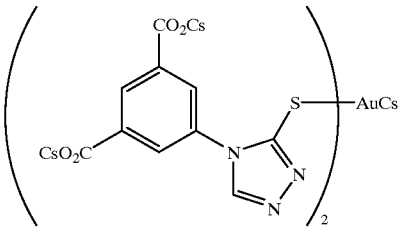

(R)

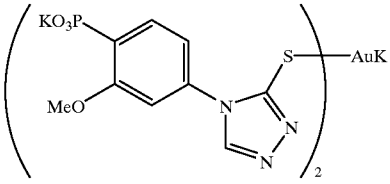

-continued (S)

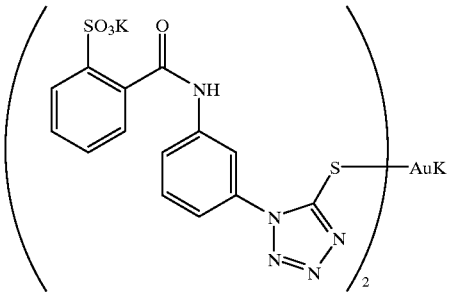

(T)

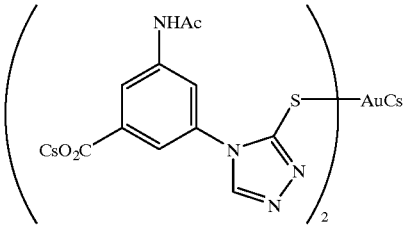

(U)

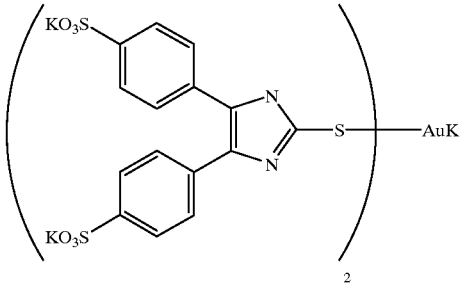

(V)

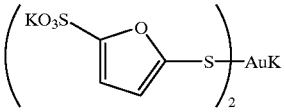

(X)

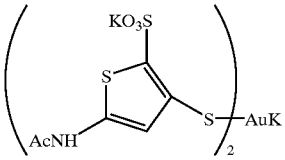

One particularly suitable complex is Compound S, potassium bis(1-[3-(2-sulfonatobenzamido)phenyl]-5-mercaptotetrazole potassium salt) aurate(I) pentahydrate.

One of the advantages of the complexes of this invention is their solubility in water. Preferably they have a solubility at 22° C. of 2 g/L, more preferably 5 g/L, and most preferably 10 g/L. Particularly suitable compounds have a solubility of greater than 20 g/L.

The invention may be suitably practiced in any photographic material. Suitable for use of the invention are transparency materials, reversal transparency materials, movie internegative film, and movie film. The invention also is suitable for color negative film. The invention finds its most preferred use in negative working color paper where the maintenance of a heat sensitivity advantage in manufacturing is achieved. The invention may be utilized with any silver halide grains and color couplers conventionally utilized in color papers and color negative film. Further, it may be utilized with any conventional spectral sensitizing dyes for which a spectral envelope matching absorbing dye is available. Typical of materials suitable for the invention are those found in *Research Disclosure* 38957, September 1996, p. 592. Color paper materials suitable for the invention may be found in *Research Disclosure* 37038, February 1995, p. 79–115.

The silver halide grains of the emulsion preferably contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

The following examples illustrate the practice of this invention. They are not intended to be exhaustive of all possible variations of the invention. Parts and percentages are by weight unless otherwise indicated.

EXAMPLE 1

Preparation of Blue Sensitive Emulsion (Blue EM-1). A high chloride silver halide emulsion was precipitated by adding approximately equimolar silver nitrate and sodium chloride solutions into a reactor vessel containing a gelatin peptizer and a thioether ripener. Cesium pentachloronitrosylosmate(II) dopant was added during the silver halide grain formation for most of the precipitation followed by addition of potassium hexacyanoruthenate(II), a small amount of KI solution and shelling without any dopant. The resultant emulsion contained cubic shaped grains of 0.64 $\mu$m in edge length size. The emulsion was optimally sensitized by the addition of a colloidal suspension of aurous sulfide followed by a heat ramp, and addition of blue sensitizing dye, D-1, 1-(3-acetamidophenyl)-5-mercaptotetrazole, an optimal amount of glutaryldiaminophenyl disulfide and Lippmann bromide, iridium hexachloroiridate.

Preparation of green sensitive emulsion (Green EM-1). A high chloride silver halide emulsion was precipitated by adding approximately equimolar silver nitrate and sodium chloride solutions into a reactor vessel containing a gelatin peptizer and a thioether ripener. Cesium pentachloronitrosyl osmate(II) dopant was added during the silver halide grain formation for most of the precipitation followed by shelling without dopant. The resultant emulsion contained cubic shaped grains of 0.34 $\mu$m in edge length size. The emulsion was optimally sensitized by the addition of a colloidal suspension of aurous sulfide followed by a heat ramp, and addition of an iridium dopant, Lippmann bromide and 1-(3-acetamidophenyl)-5-mercaptotetrazole, green sensitizing dye, D-2, and further 1-(3-acetamidophenyl)-5-mercaptotetrazole.

Preparation of red sensitive emulsion (Red EM-1). A high chloride silver halide emulsion was precipitated by adding approximately equimolar silver nitrate and sodium chloride solutions into a reactor vessel containing a gelatin peptizer and a thioether ripener. The resultant emulsion contained cubic shaped grains of 0.38 $\mu$m in edge length size. The emulsion was optimally sensitized by the addition of a solution of a colloidal suspension of aurous sulfide followed by a heat ramp, and addition of 1-(3-acetamidophenyl)-5-mercaptotetrazole, potassium bromide and red sensitizing dye, RSD-1. In addition, iridium and ruthenium dopants were added during the sensitization process.

The emulsions were combined with dispersions using techniques known in the art and the resulting light-sensitive silver halide components were applied to polyethylene resin coated paper support as described in coating format 1 to provide Example 1. The amount of absorber dye D-6 in Example 1 was adjusted as shown in Table 1 to give samples 101–106.

EXAMPLE 2

Example 2 was prepared as described in Example 1 except that D-6 was replaced by FD13 in coating format 1. The amount of absorber dye in Example 2 was adjusted as shown in Table 1 to give samples 201–206.

EXAMPLE 3

Example 3 was prepared as described in Example 1 except that RSD-1 was replaced by D-8 in coating format 1. The amount of absorber dye D-6 in Example 3 was adjusted as shown in Table 2 to give samples 301–303.

EXAMPLE 4

Example 4 was prepared as described in Example 2 except that RSD-1 was replaced by D-8 in coating format 1. The amount of absorber dye FD13 in Example 4 was adjusted as shown in Table 2 to give samples 401–403.

EXAMPLE 5

Example 5 was prepared as described in Example 1 except that for the Red EM-1, the gold sensitizer was replaced with Z', a conventional sensitizer, and S, a sensitizer of the present invention and the level of absorber dye D-6 for each sample was 1.65 mg/ft$^2$. This provided Samples 501 and 502.

EXAMPLE 6

Example 6 was prepared as described in Example 5 except that the absorber dye D-6 was replaced with FD13. at 0.83 mg/ft$_2$. This provided Samples 601 and 602.

STRUCTURES

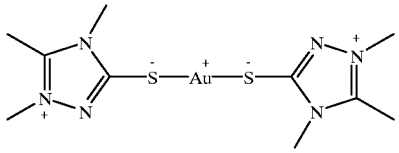

D-2

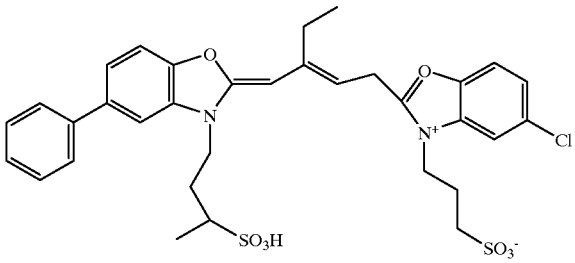

-continued
D-8
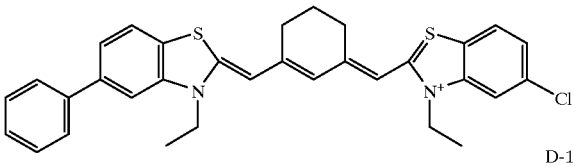
D-1
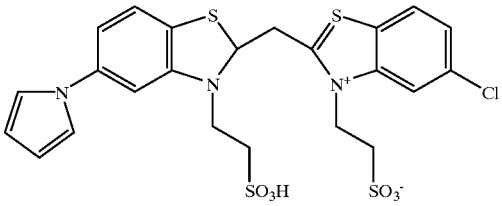
COATING FORMAT 1
| | g/m$^2$ |
|---|---|
| Layer 1 | |
| Gelatin | 1.321 |
| Silver (Blue EM-1) | 0.203 |
| Y1 | 0.418 |
| S-1 | 0.285 |
| ST-1 | 1.393 |
| D-4 | 0.008 |
| Layer 2 | |
| Gelatin | 0.65 |
| SC-1 | 0.057 |
| S-1 | 0.163 |
| Layer 3 | |
| Gelatin | 1.087 |
| Silver (Green EM-1) | 0.172 |
| M-1 | 0.365 |
| S-2 | 0.635 |
| S-3 | 0.059 |
| ST-2 | 0.404 |
| SC-1 | 0.037 |
| D-5 | 0.006 |
| Layer 4 | |
| Gelatin | 0.849 |
| UV-1 | 0.062 |
| UV-2 | 0.353 |
| SC-1 | 0.085 |
| S-4 | 0.138 |
| Layer 5 | |
| Gelatin | 1.198 |
| Silver (Red EM-1) | 0.19 |
| C-1 | 0.365 |
| S-1 | 0.358 |
| UV-2 | 0.235 |
| S-3 | 0.03 |
| D-6 | 0.02 |
| Layer 6 | |
| Gelatin | 0.645 |
| UV-1 | 0.048 |
| UV-2 | 0.277 |
| SC-1 | 0.067 |
| S-4 | 0.108 |
| Layer 7 | |
| Gelatin | 0.697 |
| Surfactant | 0.04 |
| Lubricant | 0.027 |
STRUCTURES
Y-1
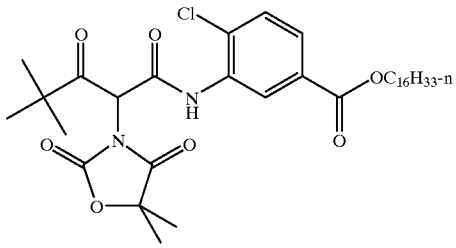
S-2
dibutyl phthalate
ST-1
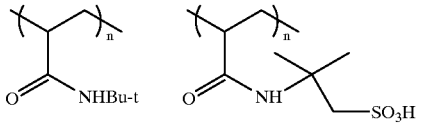
(99:1) mw = 75–80,000
D-4
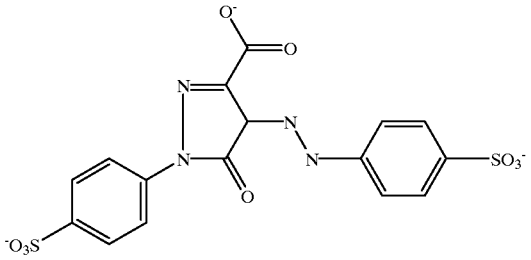
SC-1
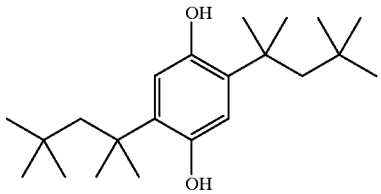
M-1
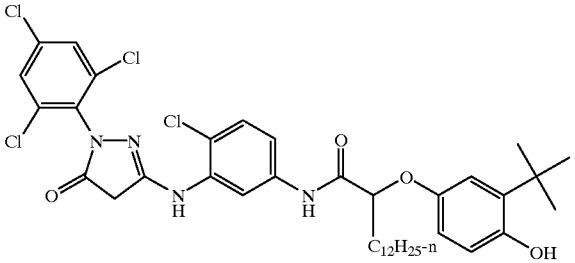
S-3
2-(2-Butoxyethoxy)ethyl acetate
ST-2
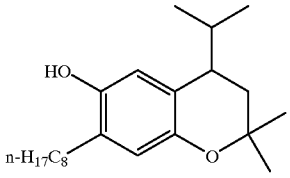

-continued

D-5

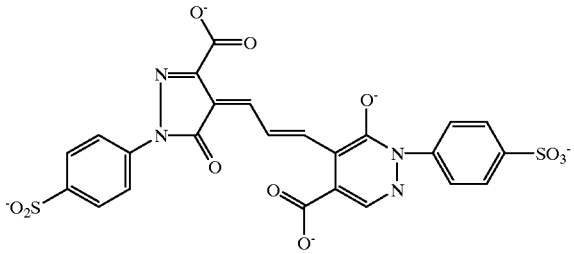

UV-1

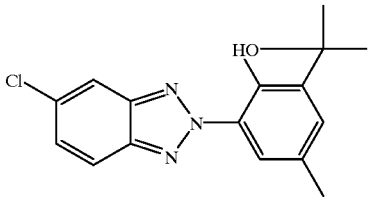

UV-2

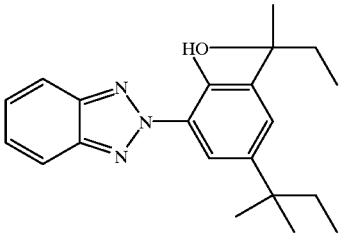

S-4

1,4-Cyclohexyldimethylene bis(2-ethylhexanoate)

C-1

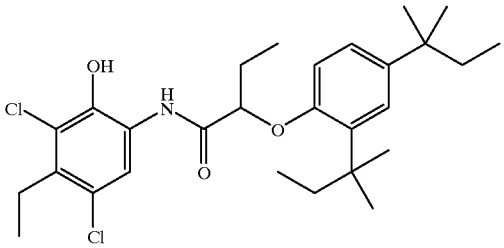

D-6

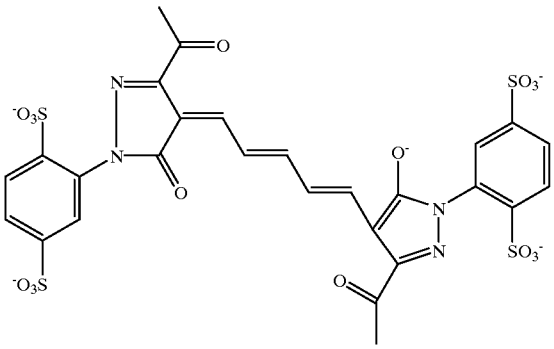

TABLE 1

| Sample | Absorber Dye | Laydown mg/ft$^2$ | Sharpness | Speed |
|---|---|---|---|---|
| 101 | D-6 | 0 | 89 | 0.38 |
| 102 | D-6 | 0.25 | 89.3 | 0.28 |

TABLE 1-continued

| Sample | Absorber Dye | Laydown mg/ft$^2$ | Sharpness | Speed |
|---|---|---|---|---|
| 103 | D-6 | 0.55 | 89.7 | 0.19 |
| 104 | D-6 | 1.1 | 90.3 | 0.08 |
| 105 | D-6 | 1.65 | 90.4 | −0.03 |
| 106 | D-6 | 2.25 | 90.3 | 0.01 |
| 201 | FD13 | 0 | 89.3 | 0.38 |
| 202 | FD13 | 0.25 | 89.7 | 0.2 |
| 203 | FD13 | 0.55 | 89.9 | 0.08 |
| 204 | FD13 | 1.1 | 90.5 | −0.16 |
| 205 | FD13 | 1.65 | 90.5 | −0.3 |
| 206 | FD13 | 2.25 | 91.1 | −0.38 |

Table 1 shows that increasing amounts of the inventive dye FD13 lead to continued sharpness improvements, whereas the comparative dye D-6 reached a maximum value in sharpness and further quantities do not provide any further sharpness improvements. It is also evident from Table 1 that the in-process speed will continue to decrease with increased amounts of the inventive dye, that is, it exhibits a linear relationship. The comparative dye D-6 fails to continue to decrease speed with increased amount of dye and exhibits a non-linear relationship. The inventive dye has the advantage of being useful over a greater range of adjustment during manufacturing. Further, it is apparent from Table 1 that a lesser amount of the inventive dye can be used to obtain the speed and sharpness position of the comparative dye.

TABLE 2

| Sample | Absorber Dye | Sensitizing Dye | Absorber Dye Laydown mg/ft$^2$ | Heat Sensitivity | Speed |
|---|---|---|---|---|---|
| 103 | D-6 | RSD-1 | 0.55 | 0.019 | 0.19 |
| 106 | D-6 | RSD-1 | 2.25 | 0.018 | 0.01 |
| 203 | FD13 | RSD-1 | 0.55 | 0.029 | 0.08 |
| 206 | FD13 | RSD-1 | 2.25 | 0.052 | −0.38 |
| 301 | D-6 | D-8 | 0.55 | −0.006 | 0.45 |
| 302 | D-6 | D-8 | 2.25 | −0.004 | 0.17 |
| 303 | D-6 | D-8 | 4.5 | 0.004 | −0.05 |
| 401 | FD13 | D-8 | 0.55 | 0.006 | 0.25 |
| 402 | FD13 | D-8 | 2.25 | 0.006 | −0.13 |
| 403 | FD13 | D-8 | 4.5 | 0.045 | −0.4 |

Table 2 shows that the sensitivity to ambient temperature changes can be controlled by the combination of absorber and sensitizing dyes. It is clear that heat sensitivities for samples 203, 206 and samples 401–403 which contain absorber dye of the present invention FD13 are greater than samples containing D-6 (Samples 103,106 and 301–303).

TABLE 3

| Sample | Absorber | Absorber Dye Laydown mg/ft$^2$ | Au Sensitizer | Heat Sensitivity | Comments |
|---|---|---|---|---|---|
| 501 | D-6 | 1.65 | Z' | 0.038 | comparison |
| 502 | D-6 | 1.65 | S | 0.016 | comparison |
| 601 | FD13 | 0.83 | Z' | 0.0523 | comparison |
| 602 | FD13 | 0.83 | S | 0.0293 | invention |

Table 3 shows the benefits of the combination of the inventive absorber dye FD13 and the use of the inventive sensitizer S. The latter reduces heat sensitivity for either absorber dye. But the combination of FD13 and S ) provides the optimum absorption envelope with the aforementioned sharpness and cost benefits and heat sensitivity reduction.

The invention has been described in detail with particular reference to preferred embodiments thereof, but it will be understood that variations and modifications can be effected within the spirit and scope of the invention.

What is claimed:

1. A silver halide photographic imaging element comprising a support and a silver halide emulsion layer, the emulsion layer comprising the combination of:

an organomercapto Au(I) complex having the formula:

[L—Au—L]M wherein the complex is symmetrical; L is an organomercapto ligand which is an antifogging, stabilizing, stabilizing or sensitizing compound, and M is a cationic counter ion;

at least one sensitizing dye; and at least one absorber dye, the wavelength of maximum absorbance of said absorber dye being substantially the same as the wavelength of maximum sensitivity of the emulsion provided by said sensitizing dye;

wherein said combination of organomercapto Au(I) complex, sensitizing dye, and absorber dye improves sharpness and beneficially controls heat sensitivity of said emulsion.

2. An imaging element according to claim 1, wherein the sensitizing dye is selected from Dye A, Dye B and mixtures thereof, wherein Dye A is of formula I or II:

I

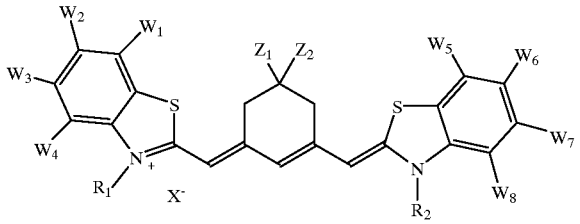

II

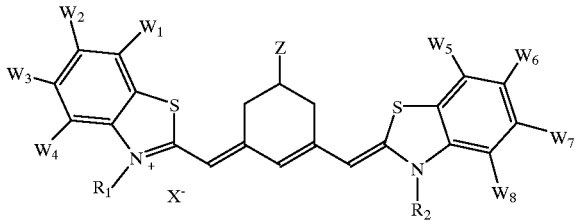

wherein:

in formula I, the substituents $W_1$–$W_8$ are chosen such that J is greater than or equal to 0.0, where J is defined a s the sum of he Hammet $\sigma_p$ values of $W_1$–$W_8$, or in formula II, the substituents $W_1$–$W_8$ are chosen such that J is greater than or equal to 0.24;

$R_1$ and $R_2$ each independently represents an alkyl group or a substituted alkyl group;

$Z_1$ and $Z_2$ each independently represents a 1–8 carbon alkyl group

X is a counterion, if needed, to balance the charge of the dye;

and Dye B is of formula I or II wherein:

in formula I, the substituents $W_1$–$M_8$ are chosen such that J is less that 0.10, or in formula II, the substituents $W_1$–$W_8$ are chosen such that J is less that −0.76414; and $R_1$ and $R_2$ each independently represents an alkyl group or a substituted alkyl group;

X is a counterion, if needed, to balance the charge of the dye;

Z is a hydrogen or halogen atom or an alkyl group or a substituted alkyl group.

3. An imaging element according to claim 1, wherein the sensitizing dye is a dye of formula (Ia), and/or a dye for formula (IIa):

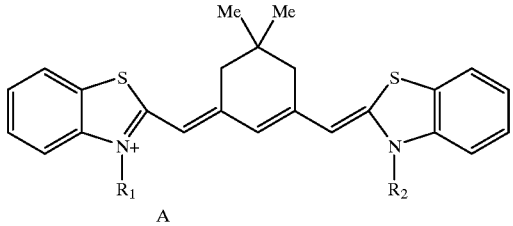

A (Ia)

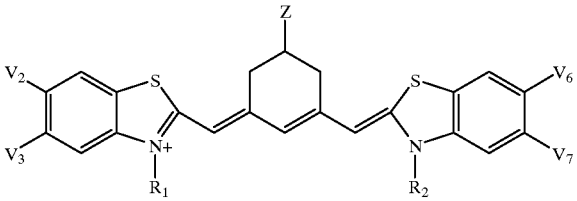

A where:

$R_1$ and $R_2$ each independently represent an alkyl group or a substituted alkyl group;

$V_2$–$V_7$ are independently H or a 1 to 8 carbon alkyl;

Z is a hydrogen or methyl;

A is a counterion if needed to balance the charge.

4. An imaging element according to claim 1, wherein the sensitizing dye is of formula:

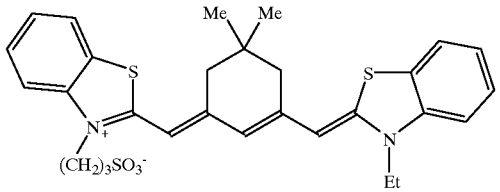

or

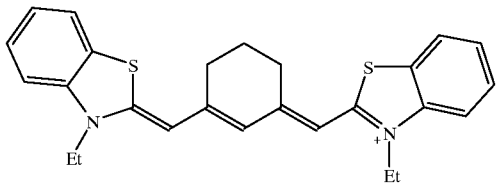

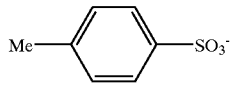

5. An imaging element according to claim 1, wherein the filter dye is of the formula:

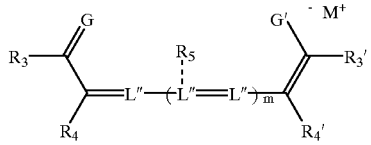

wherein:

G and G' independently represent oxygen, substituted nitrogen, or $C(CN)_2$;

$R_3$, $R_3'$, $R_4$, $R_4'$ independently represent H or a substituent, or $R_3$ and $R_4$, $R_3'$ and $R_4'$ may form a ring;

$R_5$ is an acyl alkyl, aryl, alkyloxy, aryloxy, amino, or heterocyclic, any of which may be substituted or unsubstituted;

m is 0, 1, 2, or 3;

all of the L" together define a methine chain each L" representing a methine any of which may be substituted or unsubstituted; and $M^+$ is a cation.

6. An imaging element according to claim 5, wherein the filter dye is of the formula:

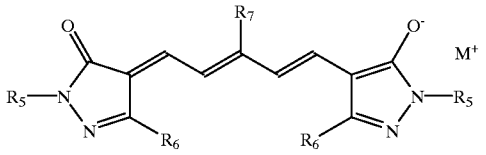

wherein $R_5$ and $R_6$ each independently represent H or a substituent, or $R_5$ and $R_6$ may form a ring;

$R_7$ is an acyl, alkoxycarbonyl, amido, carbamoyl, alkyl, aryl, alkoxy, aryloxy, amino, or heterocyclic, any of which may be substituted or unsubstituted; and $M^+$ is a cation or proton.

7. An imaging element according to claim 6, wherein $R_5$ is substituted or unsubstituted phenyl; $R_6$ is acyl amido, or carboxyl, $R_7$ is alkyl, acyl or amido; and $M^+$ is a cation.

8. An imaging element according to claim 6, wherein $R_5$ is phenyl substituted with one or more —$SO_3M$ groups, where M is a cation.

9. An imaging element according to claim 6, wherein the filter dye is a dye of formula:

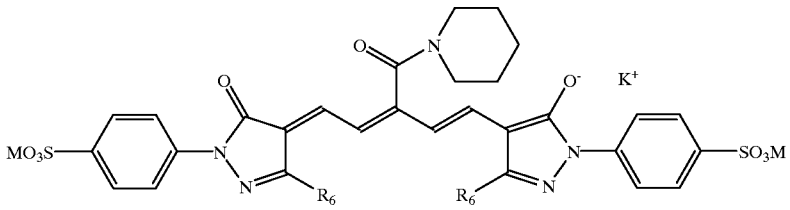

where M is a cation.

10. An imaging element according to claim 1, wherein the organomercapto Au(I) complex is of the formula:

$$[(M—SOL)_n—A—S—Au—S—A—(SOL—M)_n]M$$

wherein

M is a cationic counterion;

SOL is a solubilizing group;

A is a substituted or unsubstituted divalent organic linking group;

and n is 1 to 4 and wherein the compound is symmetrical.

11. An imaging element of claim 10, wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium.

12. An imaging element of claim 11, wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

13. An imaging element of claim 12, wherein A is a substituted or unsubstituted 5 to 6-membered heterocyclic ring with at least one atom selected from nitrogen.

14. An imaging element of claim 10, wherein M is an alkali metal or ammonium cation.

15. An imaging element of claim 14, wherein M is sodium, cesium or potassium.

16. An imaging element of claim 10 wherein SOL is a sulfato, sulfonato, sulfinato, phosphate, or carboxy group.

17. An imaging element of claim 10, wherein A is a substituted or unsubstituted aliphatic group having 1 to 20 carbon atoms, an aromatic group have from 6 to 20 carbon atoms or a 3 to 15-membered heterocyclic ring with at least one atom selected from nitrogen, oxygen, sulfur, selenium or tellurium; M is an alkali metal or an ammonium cation; and SOL is a sulfato, sulfonato, sulfinato, phosphato, or carboxy group.

18. An imaging element of claim 17 wherein A is a substituted or unsubstituted aliphatic group having 1 to 8 carbon atoms, an aromatic group having from 6 to 10 carbon atoms or a 5 to 6-membered heterocyclic ring with at least one atom selected from nitrogen.

19. An imaging element of claim 10, wherein A—(SOL—M)$_n$ is

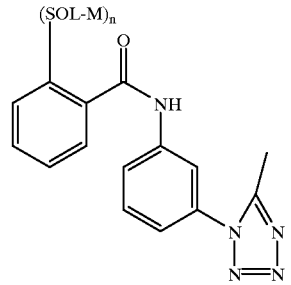

and wherein n is 1.

20. An imaging element of claim 19, wherein SOL is a sulfato, sulfonato, sulfinato, phosphato, or carboxy group.

21. An imaging element of claim 1, wherein the silver halide emulsion is greater than 90 mole % silver chloride.

22. An imaging element of claim 1, wherein the amount of the organomercapto Au(I) complex contained in the silver halide emulsion is from 0.1 μmol to 500 μmol per mole of silver.

23. An imaging element of claim 22, wherein the amount of the organomercapto Au(I) complex contained in the silver halide emulsion is from 1 μmol to 50 μmol per mole of silver.

24. An imaging element of claim 1 wherein said combination comprises organomercapto Au(I) complex S (S)

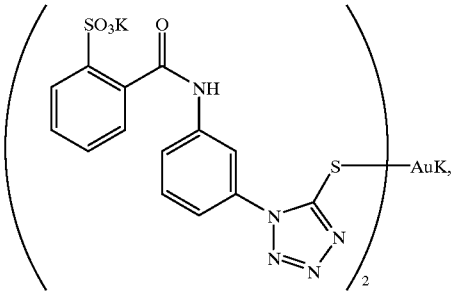

sensitizing dye D-8

D-8

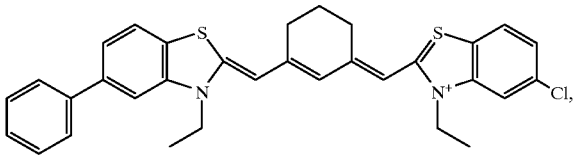

and absorber dye FD13

F13

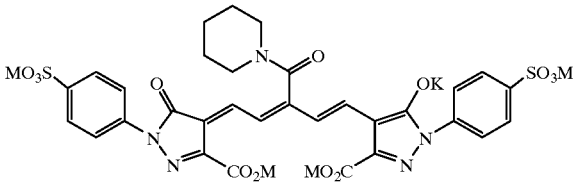

wherein $M^+$ is a cation or proton.

* * * * *